US005294746A

United States Patent [19]

Tsumura et al.

[11] Patent Number: 5,294,746

[45] Date of Patent: Mar. 15, 1994

[54] BACKING CHORUS MIXING DEVICE AND KARAOKE SYSTEM INCORPORATING SAID DEVICE

[75] Inventors: Mihoji Tsumura; Shinnosuke Taniguchi, both of Osaka, Japan

[73] Assignee: Ricos Co., Ltd., Osaka, Japan

[21] Appl. No.: 842,440

[22] Filed: Feb. 27, 1992

[30] Foreign Application Priority Data

Feb. 27, 1991 [JP] Japan ..... 3-058031

[51] Int. Cl.[5] ..... G10H 1/36

[52] U.S. Cl. ..... 84/631; 84/610; 84/645

[58] Field of Search ..... 84/603, 610, 631, 634, 84/645

[56] References Cited

U.S. PATENT DOCUMENTS

| | | | |
|---|---|---|---|
| 4,295,154 | 10/1981 | Hata et al. . | |
| 4,581,484 | 4/1986 | Bendig . | |
| 5,046,004 | 9/1991 | Tsumura et al. | 84/645 X |
| 5,052,264 | 10/1991 | Dueweke | 84/470 P |
| 5,054,360 | 10/1991 | Lisle et al. | 84/645 |
| 5,056,402 | 10/1991 | Hikawa et al. | 84/645 |
| 5,062,097 | 10/1991 | Kumaoka | 84/645 X |
| 5,079,984 | 1/1992 | Kosugi et al. | 84/645 |
| 5,119,711 | 6/1992 | Bell et al. | 84/622 |
| 5,127,303 | 7/1992 | Tsumura et al. | 84/609 |
| 5,131,311 | 7/1992 | Murakami et al. | 84/609 |
| 5,194,682 | 3/1993 | Okamura et al. | 84/645 X |

*Primary Examiner*—William M. Shoop, Jr.
*Assistant Examiner*—Jeffrey W. Donels
*Attorney, Agent, or Firm*—Thompson, Hine and Flory

[57] ABSTRACT

A karaoke system incorporating a backing chorus mixing device having a memory for storing backing chorus patterns converted to data form by breaking down and organizing the backing chorus for a particular piece of music into appropriate segments. Thus, when reproducing a piece of music created in accordance with the MIDI standard, all the chorus data corresponding to said piece of music can be read from said memory and synchronized with the music reproduction data, after which appropriate chorus patterns can be selected one by one and mixed into the music. The invention thus enables the requisite memory capacity to be kept to a minimum while at the same time enabling not only the reproduction of original sounds from music data created in accordance with the MIDI standard but also the reproduction of a mutual backing chorus sound created from data based not on the MIDI standard but obtained directly from natural human voices.

4 Claims, 3 Drawing Sheets

BACKING CHORUS MIXING DEVICE AND KARAOKE SYSTEM INCORPORATING SAID DEVICE

BACKGROUND OF THE INVENTION

1. Field of the Invention

The invention relates essentially to a backing chorus mixing device which mixes backing choruses for music reproduced from music data created in accordance with the MIDI standard.

2. Description of the Prior Art

In general terms, devices that are used to create music data in accordance with the MIDI standard and then to convert the resultant data into analog signals to be used for reproduction of the music by a reproduction device are well known.

Creation of music data in accordance with the MIDI standard enables the production of original musical sounds. In the replication of existing sounds, however, while it is possible to copy the sounds produced by many different musical instruments, it is almost impossible to recreate the sound of a backing chorus owing to the extreme complexity of the wave forms of the human voice.

SUMMARY OF THE INVENTION

The object of the present invention, which has been devised with the above problem in mind, is to enable the creation, in the case of music which includes a backing chorus, of the sounds of musical instruments using MIDI standard music data while at the same time reproducing an authentic backing chorus sound using data based not on the MIDI standard but on the natural sounds of the human voice.

It is, of course, fairly common for the backing chorus for a single piece of music to involve the repetition of more than one such pattern. The invention therefore breaks down the backing chorus of a piece of music into suitable segments which it then orders to produce a plurality of chorus patterns. A full backing chorus can then be formed by combining one or more such chorus patterns as appropriate. In this way it is also possible to keep the amount of memory space used to a minimum.

The means employed in the present invention to achieve said object is illustrated in FIG. 1 and consists of a music reproduction means 20, which reproduces music using input music data created in accordance with the MIDI standard, a memory means 30, which converts to data form and then stores a plurality of chorus patterns obtained by breaking down and organizing the backing chorus for a particular piece of music into suitable segments, a chorus data reading means 40, which inputs the specified music reproduction data and then reads the data for all the chorus patterns corresponding to said music reproduction data from the memory means 30, and a chorus data mixing means 50, which receives the data output of the chorus data reading means 40, synchronizes said data with the music reproduction data and then selects the appropriate chorus patterns one by one and mixes them into the music.

Using the above configuration, music can be reproduced by the music reproduction means 20 from MIDI standard music data. At the same time, the backing chorus corresponding to the music reproduction data can be read from the memory means 30 by the chorus data reading means 40 and then synchronized with the music reproduction data and mixed with the music by the chorus data mixing means 50. It is in this way possible not only to create original musical sounds from MIDI standard music data but also to obtain a natural sounding backing chorus sound by reproducing said backing chorus in accordance with data based not on the MIDI standard but obtained directly from natural human voices. The present invention enables the memory means 30 to store in data form a plurality of chorus patterns obtained by breaking down and organizing the backing chorus for a particular piece of music into appropriate segments. As a result, it is possible for the chorus data reading means 40 to read from the memory means 30 in a single operation all the chorus pattern data relating to said piece of music and for the chorus data mixing means 50 to synchronize said data with the music reproduction data and then select appropriate chorus patterns one by one and mix them into the music. By storing backing choruses in this way as a plurality of patterns rather than storing each one individually and in its entirety for each piece of music, it is possible to reduce the amount of memory storage space required.

DETAILED DESCRIPTION OF THE PREFERRED EMBODIMENT

Figure 1:
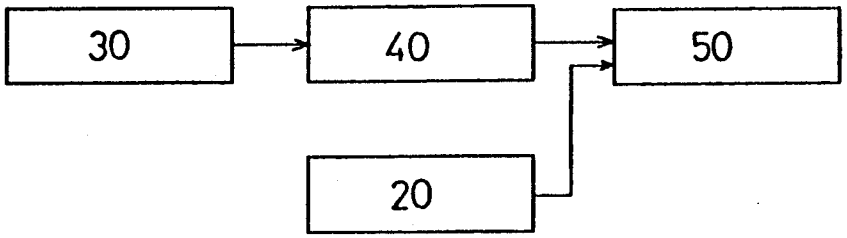
FIG. 1 is a block diagram illustrating the total configuration of the invention.
Figure 2:
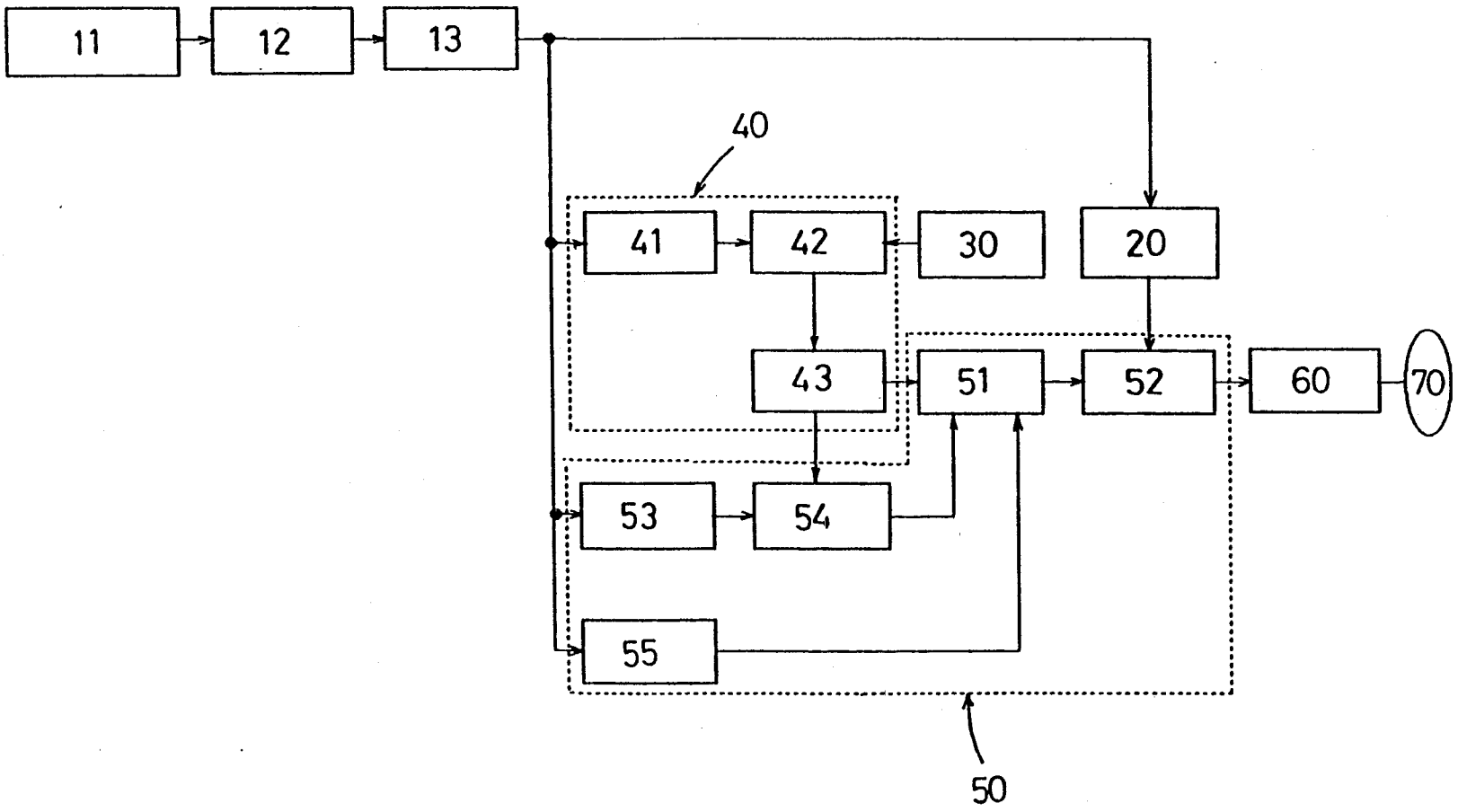
FIG. 2 is a block diagram illustrating the total configuration of the preferred embodiment.

There follows a detailed description of the preferred embodiment of the invention by reference to the accompanying drawings. FIG. 2 shows a karaoke system incorporating the backing chorus mixing device of the preferred embodiment. The system comprises a center to which are connected a plurality of terminals through the medium of a telephone line. 11 is a control device installed in the center, said control device 11 itself comprising a host computer and a main memory device, said host computer being connected to a telephone line by means of a modem (not shown in the drawing). Said main memory device is used to store data relating to a plurality of pieces of music individually, said data being created in accordance with the MIDI standard. Said music data is interspersed as appropriate with backing chorus control data.

The devices 12–70 described below are each incorporated into each of the aforementioned terminals. Each terminal also incorporates a modem (not shown in the drawing) which is connected to said telephone line. 12 is the main reading device which is used to access said host computer by way of said telephone line and to read music data and control data for individual pieces of music from the main memory device. 13 is a MIDI standard data decoder which decodes music and control data only. 20 is a music reproduction means which may, for example, form part of a MIDI sound source and which creates analog signals in accordance with music data received from the decoder 13.

Figure 3:
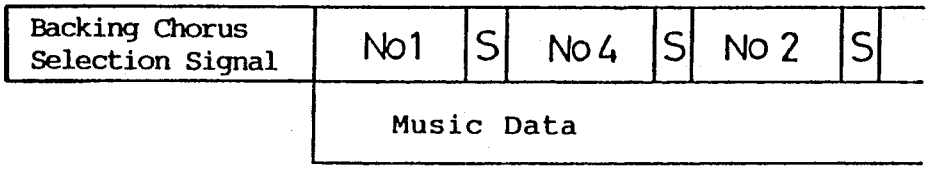
FIG. 3 is a conceptual illustration of the configuration of the music data and control data.

30 is a memory means in which the backing chorus corresponding to a particular piece of music data is converted into data form and stored. Conversion to data form may be carried out by the ADPCM (adaptive differential pulse-code modulation) method sampling at 8 KHz, for example, or by an alternative method is so desired. The important point is to make sure the actual backing chorus is converted into some sort of data form. It is fairly common for the backing chorus for a particular piece of music to fall into several repeating patterns. For this reason, the backing chorus for a piece of music can be broken down into segments as appropriate and then organized to form a plurality of chorus patterns. Each chorus pattern is then converted individually to data form and stored in the memory means 30. The chorus patterns which combine to form the backing chorus for a particular piece of music are then assigned a backing chorus ID which constitutes their link to the music data. The chorus patterns which occur within a single piece of music are also each assigned an individual chorus number. There now follows an explanation by reference to FIG. 3 of the conceptual relationship between the aforementioned music data and the control data. The control data in the figure starts from the point at which the backing chorus selection signal, which functions as the backing chorus ID, is received. From that point on, as the piece of music progresses, a chorus number is output each time a different chorus pattern is required. A chorus start signal S is inserted at the point at which the reproduction of each fresh chorus pattern is to start.

The decoder 13 is connected to a backing chorus selection signal extractor 41 which extracts backing chorus selection signals from the aforementioned control data. The backing chorus selection signal extractor 41 is in turn connected to a chorus data reading unit 42 which is itself connected to a chorus buffer 43. When the backing chorus for a particular piece of music has been read out of the aforementioned memory means 30 in response to a backing chorus selection signal extracted from the stream of control data, it is then stored in the chorus buffer 43.

The decoder 13 is also connected to a chorus number extractor 53 which reads the chorus numbers one by one from the control data stream. The chorus number extractor 53 and the aforementioned chorus buffer 43 are connected to an address retriever 54 which specifies the start and end addresses of the chorus pattern corresponding to the chorus number which has been extracted and then, on the basis of this address specification, reads the appropriate chorus pattern out of the data in the chorus buffer 43. Said chorus pattern is then input to the voice mixing device 51 where it is converted to analog signals by the ADPCM method. The voice mixing device 51 is connected in the following order to a mixer 52, an amplifier 60 and a speaker 70. Connected to the decoder 13 is the chorus start signal extractor 55 which extracts successive chorus start signals S from the stream of control data. Said chorus start signal S is then input to the voice mixing device 51 where it triggers the output of the chorus pattern to the mixer 52. Said mixer 52 then mixes the music reproduced by the music reproduction means 20 and the chorus pattern and the resultant signals are output to an amplifier 60 for amplification and finally to a speaker 70 for conversion into sound.

Within the overall configuration outlined above, the backing chorus selection signal extractor 41, the chorus data reader 42 and the chorus buffer 43 together constitute the chorus data reading means 40 which inputs the music reproduction data and the control data, and then reads all the chorus pattern data for the piece of music corresponding to said music data out of the memory means 30. Similarly, the voice mixing unit 51, the mixer 52, the chorus number extractor 53, the address retriever 54 and the chorus start signal extractor 55 together constitute the chorus data mixing means 50, which accepts output from the chorus data reading device 40, synchronizes it with the music reproduction data and then selects appropriate chorus patterns one by one and mixes them into the music.

In the preferred embodiment outlined above, it is possible, therefore, not only to produce original sounds from music data created in accordance with the MIDI standard but also to obtain a natural backing chorus sound by reproducing the backing chorus in accordance with data based not on the MIDI standard but obtained directly from natural human voices. The memory means 30, moreover, stores in data form a plurality of chorus patterns obtained by breaking down and organizing the backing chorus for a particular piece of music into appropriate segments. As a result, it is possible for the chorus data reading device 42 to read from the memory means 30 into the chorus buffer 43 in a single operation all the chorus pattern data for a particular piece of music. The address retriever 54 then synchronizes said chorus pattern data with the music reproduction data, selects specified chorus patterns one by one, converts them to analog signals and mixes them into the music. Thus, by storing the backing chorus as a plurality of patterns rather than storing each one individually and in its entirety for each piece of music, it is possible to reduce the amount of memory storage space required.

Furthermore, in the preferred embodiment outlined above, the backing chorus mixing device of the invention has been incorporated into a karaoke system which comprises a center plus a plurality of terminals which are connected to said center through the medium of a telephone line. The backing chorus mixing device of the invention could, however, be just as easily incorporated into a less complex system. In other words, the host computer could be replaced by a straightforward control unit which could then be connected with the main reading device directly rather than via a telephone line. The system comprising the main memory device and the speaker could all then be housed in a single location and the whole system could be installed for use in an ordinary family home.

What is claimed is:

1. A karaoke system which generates music having a backing chorus including instrumental and vocal music comprising:

a backing chorus mixing device having music reproduction means for inputting music data created in accordance with the MIDI standard and generating reproduction music data in accordance with said music data, means for breaking backing chorus vocal data into segments, and organizing said segments into a plurality of backing chorus patterns, means for converting each of said backing chorus patterns to control data form not on the MIDI standard, memory means for storing a plurality of converted backing chorus patterns, such that duplicate patterns are not stored, chorus data reading means for inputting the reproduction music data and control data, and subsequently reading all the control data for the piece of music corresponding to said music data out of the memory means, chorus data mixing means for accepting the output of the chorus data reading means, synchronizing said chorus data with the music reproduction data, and selecting the specified chorus patterns one by one and mixing them into the music;

a center and a plurality of terminals connected to said center through the medium of a telephone line;

said center including a modem connected to the telephone line, a host computer connected to said modem, and a main memory device which is connected to the host computer and which stores said reproduction music data and said control data; and each of said terminals including a modem connected to the telephone line, a main reading device connected to said modem and which reads the music data and control data, and a decoder connected to said main reading device and to said backing chorus mixing device and which decodes said music data and control data.

2. The backing chorus mixing device according to claim 1 in which the aforementioned music reproduction means forms part of a MIDI sound source.

3. The backing chorus mixing device according to claim 1 in which the backing chorus data stored in the aforementioned memory means is obtained using the ADPCM method whereby sampling of the back chorus is carried out at a specified frequency.

4. A karaoke system which generates music having a backing chorus including instrumental and vocal music comprising:

a backing chorus mixing device having music reproduction means for inputting music data created in accordance with the MIDI standard and generating reproduction music data in accordance with said music data, memory means for storing a plurality of backing chorus patterns converted to control data form not on the MIDI standard by breaking down and organizing each of said backing chorus patterns for a particular piece of music data into appropriate segments, chorus data reading means for inputting the reproduction music data and control data, and subsequently reading all the control data for the piece of music corresponding to said music data out of the memory means, chorus data mixing means for accepting the output of the chorus data reading means, synchronizing said chorus data with the music reproduction data, and selecting the specified chorus patterns one by one and mixing them into the music;

a center and a plurality of terminals connected to said center through the medium of a telephone line;

said center including a modem connected to the telephone line, a host computer connected to said modem, and a main memory device which is connected to the host computer and which stores said reproduction music data and said control data;

each of said terminals including a modem connected to the telephone line, a main reading device connected to said modem and which reads the music data and control data, and a decoder connected to said main reading device and to said backing chorus mixing device and which decodes said music data and control data; and in which said control data starts from the backing chorus selection signal, which functions as its ID, said control data containing chorus numbers, which occur one by one during the course of the music in the same order in which the chorus patterns are required, and said control data also containing chorus start signals, which are inserted at the points where the reproduction of each of said chorus patterns is to begin.

* * * * *